US008474641B2

(12) United States Patent
Hays et al.

(10) Patent No.: US 8,474,641 B2
(45) Date of Patent: Jul. 2, 2013

(54) ICE CUP

(76) Inventors: Barrett K. Hays, San Antonio, TX (US); Greta Hays, San Antonio, TX (US)

( * ) Notice: Subject to any disclaimer, the term of this patent is extended or adjusted under 35 U.S.C. 154(b) by 56 days.

(21) Appl. No.: 13/090,805

(22) Filed: Apr. 20, 2011

(65) Prior Publication Data

US 2012/0267378 A1 Oct. 25, 2012

(51) Int. Cl.

| | |
|---|---|
| ***B65D 21/02*** | (2006.01) |
| ***A47G 19/23*** | (2006.01) |
| ***A47G 19/22*** | (2006.01) |

(52) U.S. Cl.

USPC ..... 220/23.89; 220/703; 220/720

(58) Field of Classification Search

USPC ..... 220/23.89, 23.86, 505, 703, 592.17, 220/592.16, 551, 530, 529, 528, 495.03, 220/500, 723, 720; 229/403; 206/577, 218

IPC ..... A47G 19/23,19/22

See application file for complete search history.

(56) References Cited

U.S. PATENT DOCUMENTS

| | | | | | |
|---|---|---|---|---|---|
| 1,009,406 | A | * | 11/1911 | Graham | 220/592.17 |
| 2,327,078 | A | * | 8/1943 | Teetor | 220/23.83 |
| 2,679,067 | A | * | 5/1954 | Delmas | 15/263 |
| 2,853,222 | A | * | 9/1958 | Gallagher | 229/402 |
| 3,119,543 | A | * | 1/1964 | Walker | 229/117.3 |
| 3,199,757 | A | * | 8/1965 | McConnell | 229/400 |
| 3,442,435 | A | * | 5/1969 | Huston et al. | 220/528 |
| 4,126,261 | A | * | 11/1978 | Cook | 229/120.08 |
| 4,854,474 | A | | 8/1989 | Murray et al. | |
| 5,284,028 | A | * | 2/1994 | Stuhmer | 62/457.3 |
| 5,603,219 | A | | 2/1997 | Kolb | |
| 5,775,570 | A | * | 7/1998 | Kim | 229/4.5 |
| 5,806,708 | A | | 9/1998 | Schwab | |
| 5,934,501 | A | * | 8/1999 | Wright et al. | 220/528 |
| 6,213,335 | B1 | | 4/2001 | Wilson | |
| 7,448,510 | B2 | | 11/2008 | Pavlopoulos | |
| 2004/0112904 | A1 | | 6/2004 | Kurs | |
| 2005/0072180 | A1 | | 4/2005 | Lee | |
| 2008/0202150 | A1 | * | 8/2008 | Siordia | 62/457.3 |
| 2011/0244108 | A1 | * | 10/2011 | Rabin | 426/589 |

* cited by examiner

*Primary Examiner* — Robert J Hicks

(74) *Attorney, Agent, or Firm* — Kammer Browning PLLC

(57) ABSTRACT

A stackable, self-standing, liquid-tight, disposable drinking cup to keep ice separated from a beverage in the cup to permit cooling without resultant dilution. A collapsible plastic film liner is secured to certain inner cup surfaces to provide a flexible wall for dividing the interior into two separate areas. The liner forms a pocket with an expandable top edge which may be pulled away from the cup body to hold ice. The pocket may be made of one film layer with the edges of the pocket attached to the cup body. Alternatively, the pocket may be made of two layers joined by a heat sealed seam with the film layer next to the cup body attached to the cup wall at least along a portion of the top edge. The container body may be manufactured from conventional materials. Conventional cup dispensers, beverage dispensers, cup lids, and straws may be utilized without modification of design.

4 Claims, 6 Drawing Sheets

(A - A′)

(B – B′)

(C - C′)

ICE CUP

BACKGROUND OF THE INVENTION

1. Field of the Invention

The present invention relates generally to beverage cups and containers. The present invention relates more specifically to stackable, disposable beverage cups and containers having partitions to separate a beverage from ice in the cup or container.

2. Description of the Related Art

There are many beverage cups and containers in the prior art which are directed to keeping a beverage cool. Some of these designs provide a container having one or more partitions. Some containers are designed with one or more liquid-filled cavities which can be frozen prior to use in order to cool a beverage that is poured into the container. There are various designs for these cooling cavities. Some cavities are located in the side walls of the container, while others use inserts of various shapes and sizes which can be placed in hollow portions of the container.

Other beverage containers are designed with rigid partitions in order to separate two or more fluids within the same container but which are not designed to allow the container to be stacked. A stackable device in the prior art which is designed to keep crushed ice or ice cubes away from the beverage fails to keep water from melting ice cubes separate from the beverage in the container.

There is a need in the art to have a stackable, disposable beverage cup which prevents water from melting ice from diluting the beverage in the container, but which allows sufficient contact between the ice and the beverage to keep the liquid cooled.

Ideally, such a device would be economical to make and simple to use. It would be desirable for the container to be of standard size and materials such that the cup could be used in conventional dispensers without modification of design.

SUMMARY OF THE INVENTION

Therefore, the present invention provides a stackable, self-standing, liquid-tight, disposable drinking cup that is designed to keep ice separated from a beverage in the cup. This separation is accomplished via a polymer plastic film liner secured to certain inner surfaces of the cup to provide a flexible wall for dividing the interior of the cup into two separate areas. The liner forms a pocket with an expandable top edge which may be pulled away from the cup body in order to hold ice.

The pocket may be made of one film layer with the edges of the pocket attached to the cup body by an adhesive seal or similar means. Alternatively, the pocket may be made of two layers joined by a heat sealed seam. In this configuration, the film layer next to the cup body is attached to the cup wall at least along a portion of the top edge. The container body may be made from any of the materials typically used for disposable drinking cups such as treated paper, expanded polystyrene foam, or other plastics.

This design permits cooling of the beverage without the resultant dilution which inevitably occurs upon the melting of the ice. The plastic film liner is collapsible against the inside of the cup, thus allowing the cups to be neatly stacked one inside another. Conventional cup dispensers may be utilized to hold a stack of these nested cups without modification of design. The cups may be used with standard cup lids, straws, and drink dispensers. The cup may be manufactured from conventional materials and may be of standard shape, size, and weight with the addition of the plastic film liner.

BRIEF DESCRIPTION OF THE DRAWINGS

A more complete understanding of the present invention may be had by reference to the following detailed description taken in conjunction with the accompanying drawings, wherein.

DETAILED DESCRIPTION OF THE PREFERRED EMBODIMENTS

The present invention is designed to facilitate the use of current dispensers, holders, lids, and straws. The expandable pocket wall fully collapses against the inside of the container and takes up very little space inside the cup. When stacking the cups, the collapsed pocket conforms to the shape of the cup and permits easy nesting of the containers. The stack of containers fits conveniently inside current cup stack holders and can be individually dispensed as easily as current conventional disposable cups. The standard plastic lids will fit on the top of this cup and a standard straw may be used.

To use the disposable container of the present invention, the user pulls one of the cups from the stack of cups in the dispenser. If the user wishes to use ice, but does not want the ice to mix with the beverage, the user grabs the ice pocket tab and pulls it toward the center of the container, thus expanding the pocket wall and forming a pocket for the ice. The user then fills the pocket with ice and fills the other portion of the cup with the desired beverage. The user puts the lid on the beverage and the straw into the opening in the lid over the liquid beverage. The user can drink the beverage without having the ice melt and dilute the drink.

The disposable container of the present invention is simple in design and materials and easy to manufacture. As mentioned above, the cup body may be made of the same materials currently used for disposable drinking cups such as treated paper, expanded polystyrene foam, or other plastics. The pocket liner may be made of any polymer plastic film of suitable flexibility and strength to easily and smoothly conform to the inside of the cup body in its collapsed position and to evenly support the weight of the ice in the container in its expanded position.

Figure 1:
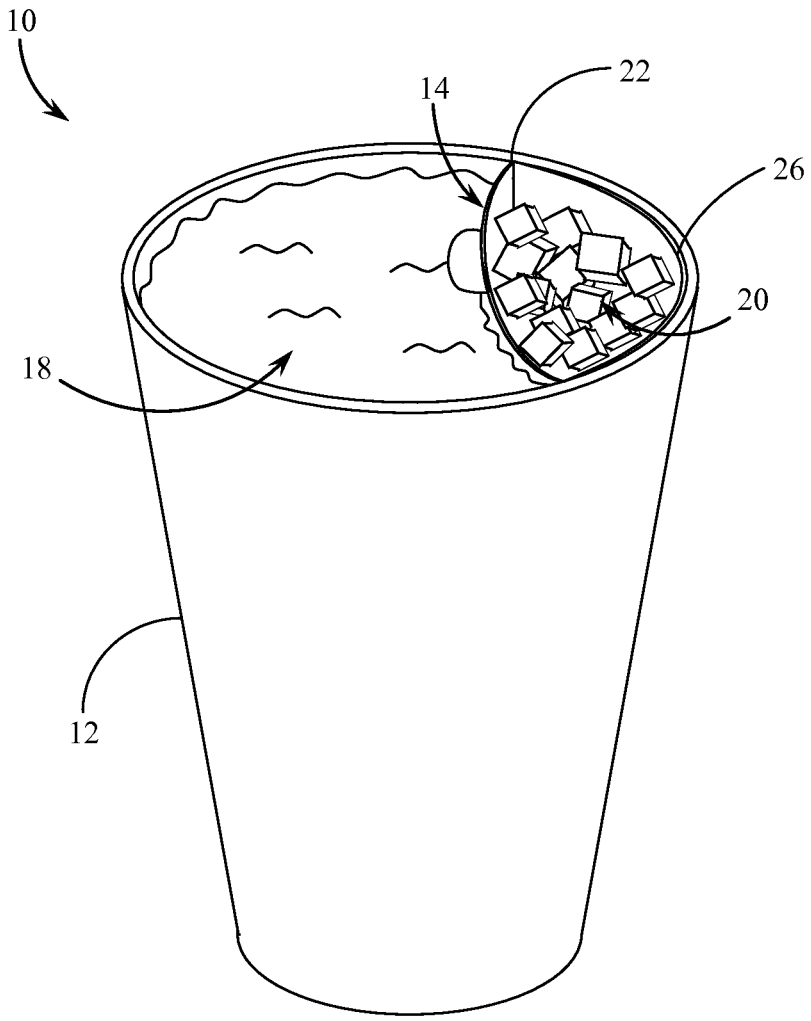
FIG. 1 is a perspective view of a first preferred embodiment of the container of the present invention shown expanded with ice in the pocket.

Reference is made first to FIG. 1 for a perspective view of a first preferred embodiment of the container of the present invention shown with the ice pocket expanded and holding ice. Disposable container 10 is shown with cup body 12 filled with liquid beverage 18 and ice 20. The area of the disposable container formed by the expandable pocket wall 22 and the fixed pocket wall 26 is shown filled with ice 20. Liquid beverage 18 is shown outside ice pocket 14, in the other section of disposable container 10. This view shows the container filled with ice and beverage and ready to use.

Figure 2:
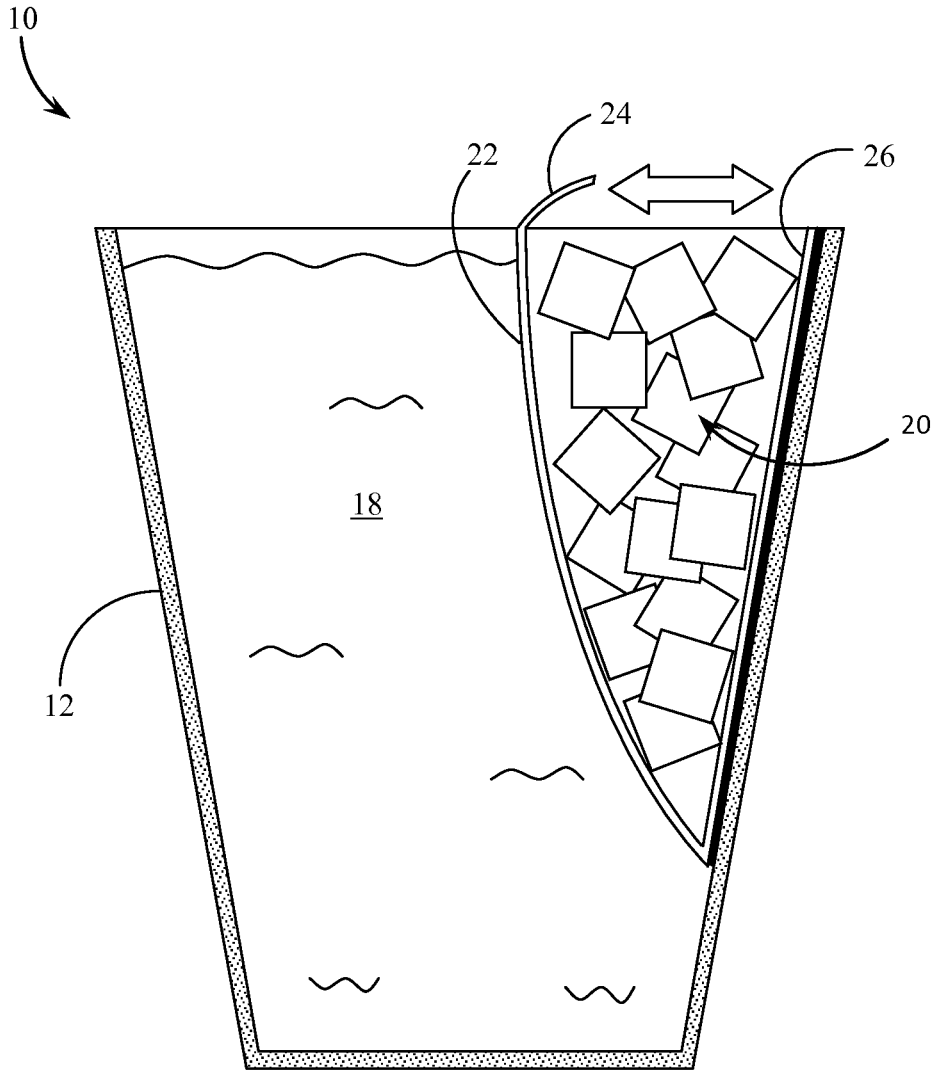
FIG. 2 is a partial cross-sectional view along section line A-A' (FIG. 3) of a first preferred embodiment of the container of the present invention shown expanded with ice in the pocket.

FIG. 2 is a partial cross-sectional view along section line A-A' (FIG. 3) of a first preferred embodiment of the container of the present invention shown expanded with ice in the pocket. In this embodiment, the relationship of the cup body 12 to the pocket walls (22 and 26) and the structure of the expandable pocket wall 22 and the fixed pocket wall 26 within the cup body 12 are shown. The disposable container 10 is once again filled with liquid beverage 18 in the area of the cup body 12 outside the expandable pocket wall 22, and with ice 20 within the area formed by the expandable pocket wall 22 and the fixed pocket wall 26.

Still referring to FIG. 2, ice pocket tab 24 is attached to expandable pocket wall 22. In order to use the ice pocket, the user pulls the ice pocket tab 24 which pulls the expandable pocket wall 22 away from the fixed pocket wall 26, thereby expanding the ice pocket 14. In this embodiment, the fixed pocket wall 26 is adhered to cup body 12, thus providing a pocket for the ice. The ice 20 and any water from melted ice are maintained in the ice pocket 14 separate from the liquid beverage 18.

Alternatively, the expandable pocket wall 22 may be attached to the cup body 12 along the margins of the expandable pocket wall, thus eliminating the need for the fixed pocket wall 26. In this embodiment, the ice 20 and water from melted ice are still kept separate from the liquid beverage 18 because the margins of the expandable pocket wall 22 are firmly adhered to the cup body 12, thus providing a liquid-tight pocket for the ice.

Figure 3:
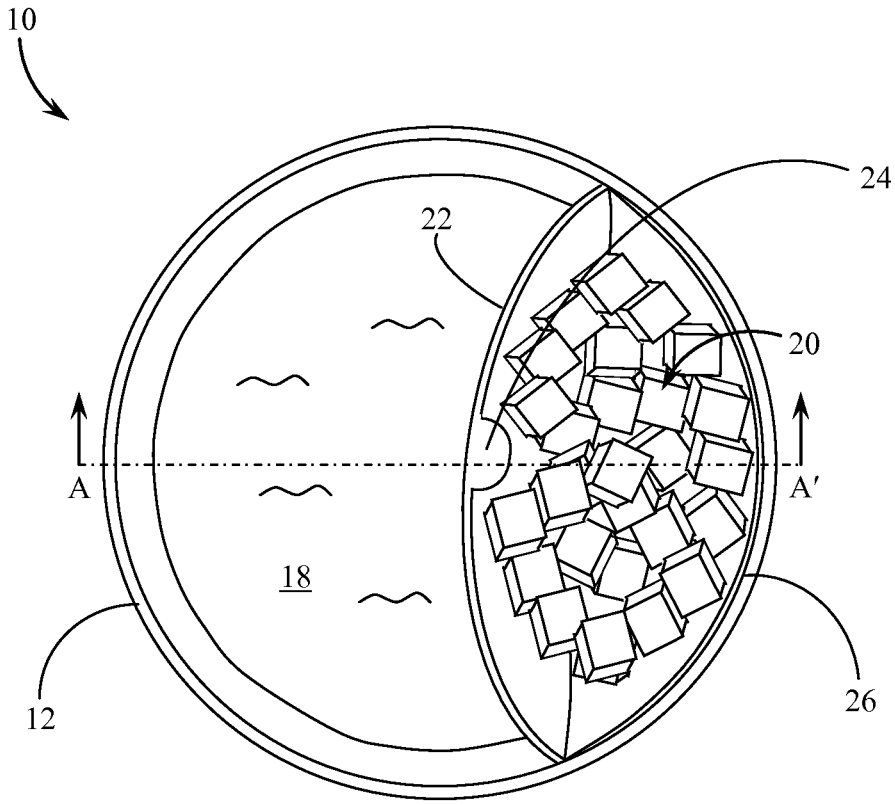
FIG. 3 is a top plan view of a first preferred embodiment of the container of the present invention shown expanded with ice in the pocket.

FIG. 3 is a top plan view of a first preferred embodiment of the container of the present invention shown expanded with ice in the pocket. FIG. 3 shows the fixed pocket wall 26, the expandable pocket wall 22 and the ice pocket tab 24 with the disposable container 10 filled with liquid beverage 18 and ice 20. Once again, the ice 20 within the ice pocket 14 is kept totally separate from the liquid beverage 18.

Figure 4A:
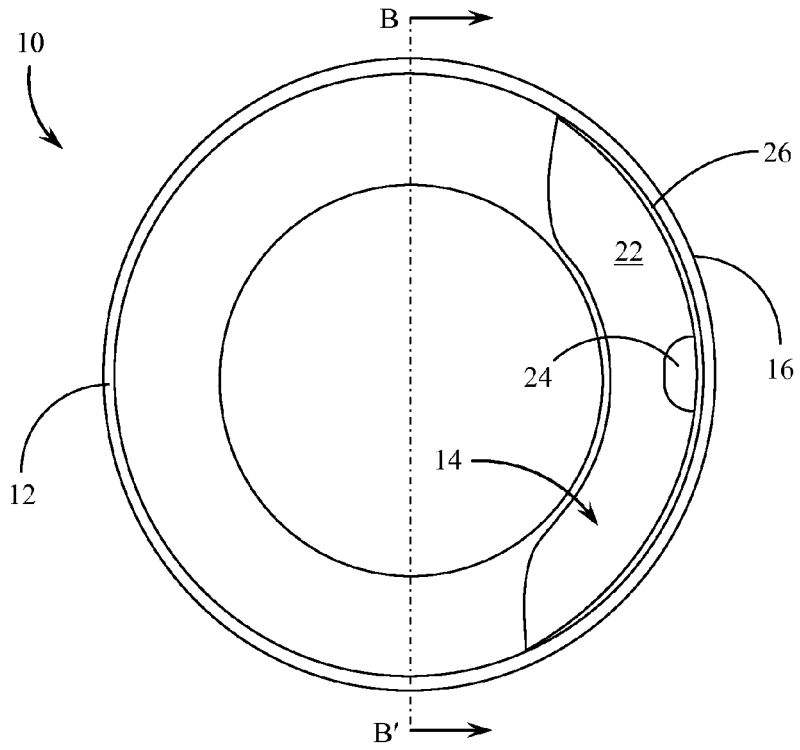
FIG. 4A is a top plan view of a first preferred embodiment of the container of the present invention shown without ice in the pocket (pocket collapsed/closed).
Figure 4B:
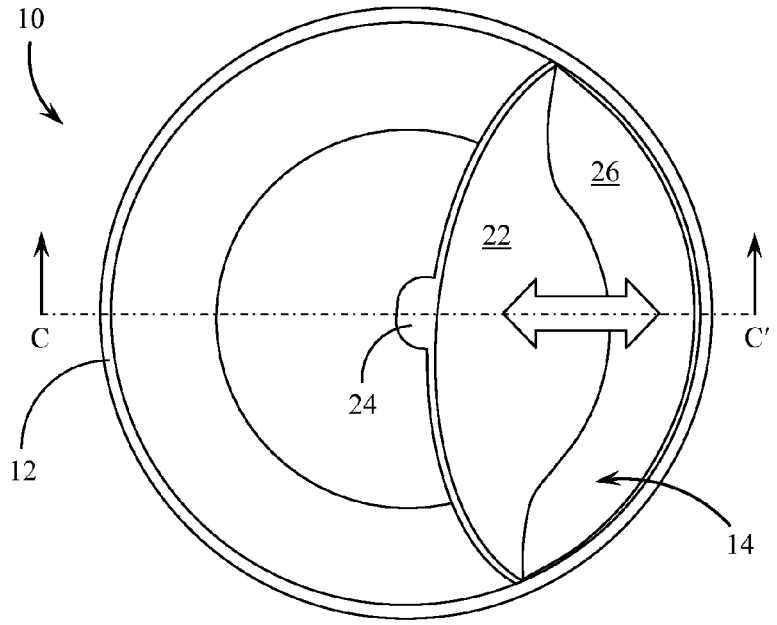
FIG. 4B is a top plan view of a first preferred embodiment of the container of the present invention shown expanded without ice in the pocket (pocket expanded/open).

FIGS. 4A and 4B provide two different top plan views of the present invention. FIG. 4A is a top plan view of a first preferred embodiment of the container of the present invention shown without ice in the pocket (pocket collapsed/closed). FIG. 4B is a top plan view of this preferred embodiment of the container shown expanded without ice in ice pocket 14 (pocket expanded/open).

In FIG. 4A, the disposable container 10 is shown looking into the cup body 12 with the ice pocket 14 collapsed. The expandable pocket wall 22 is shown flush against the fixed pocket wall 26, which is adhered to the cup body 12 in this embodiment. The fixed pocket wall may be adhered to the cup body along the expandable top edge or the entire surface adjacent to the cup body. The ice pocket tab 24 is shown at the periphery of cup body 12 in this closed configuration.

In FIG. 4B, the disposable container 10 is once again shown looking into the cup body 12, but this time with the ice pocket 14 expanded. The expandable pocket wall 22 is shown in open position, curving toward the center of container 10. As shown by the arrow in FIG. 4B, ice pocket tab 24 is used to pull the expandable pocket wall 22 away from the fixed pocket wall 26. Alternatively, as described above, the container can be designed with the expandable pocket wall 22 attached to the cup body 12 along the margins of the expandable pocket wall, thus eliminating the need for fixed pocket wall 26.

Figure 5:
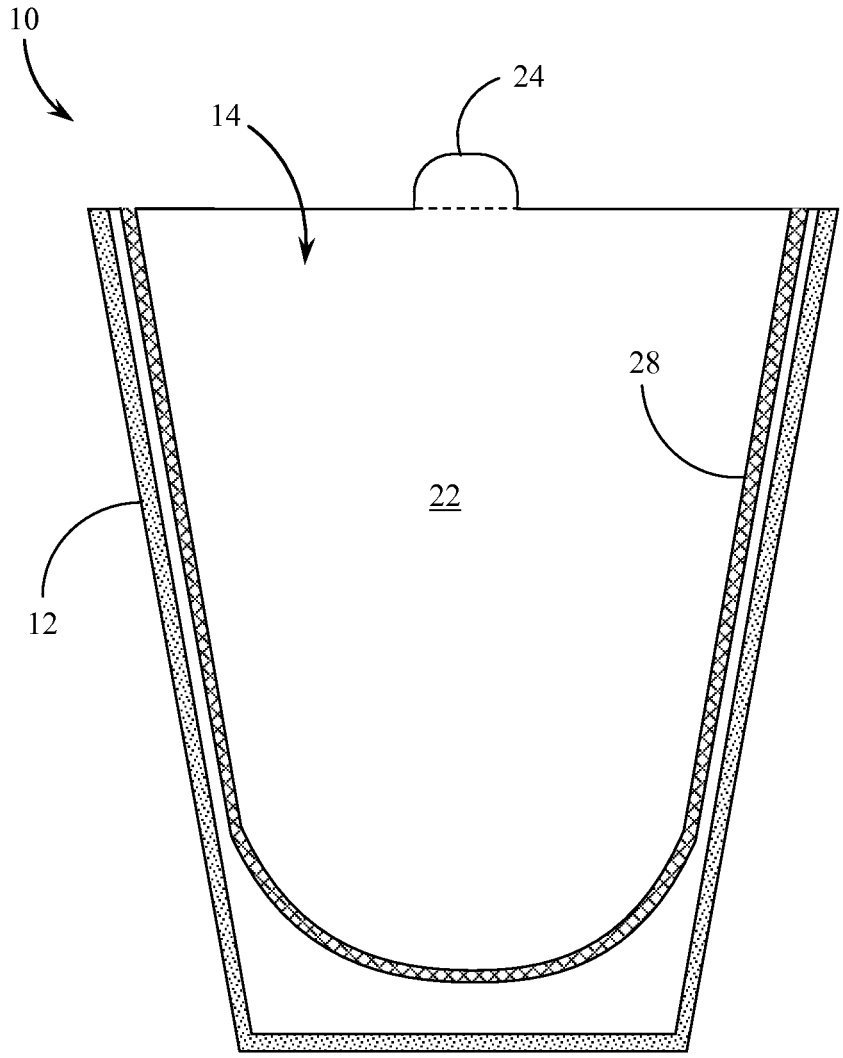
FIG. 5 is a partial cross-sectional view along section line B-B' (FIG. 4A) for the first preferred embodiment of the container of the present invention.

FIG. 5 discloses a partial cross-sectional view along section line B-B' (FIG. 4A) for the first preferred embodiment of the container of the present invention. In this view, the outline of pocket wall seam 28 is clearly seen where the border of the expandable pocket wall 22 attaches to fixed pocket wall 26 (not shown in this figure) forming ice pocket 14.

Figure 6:
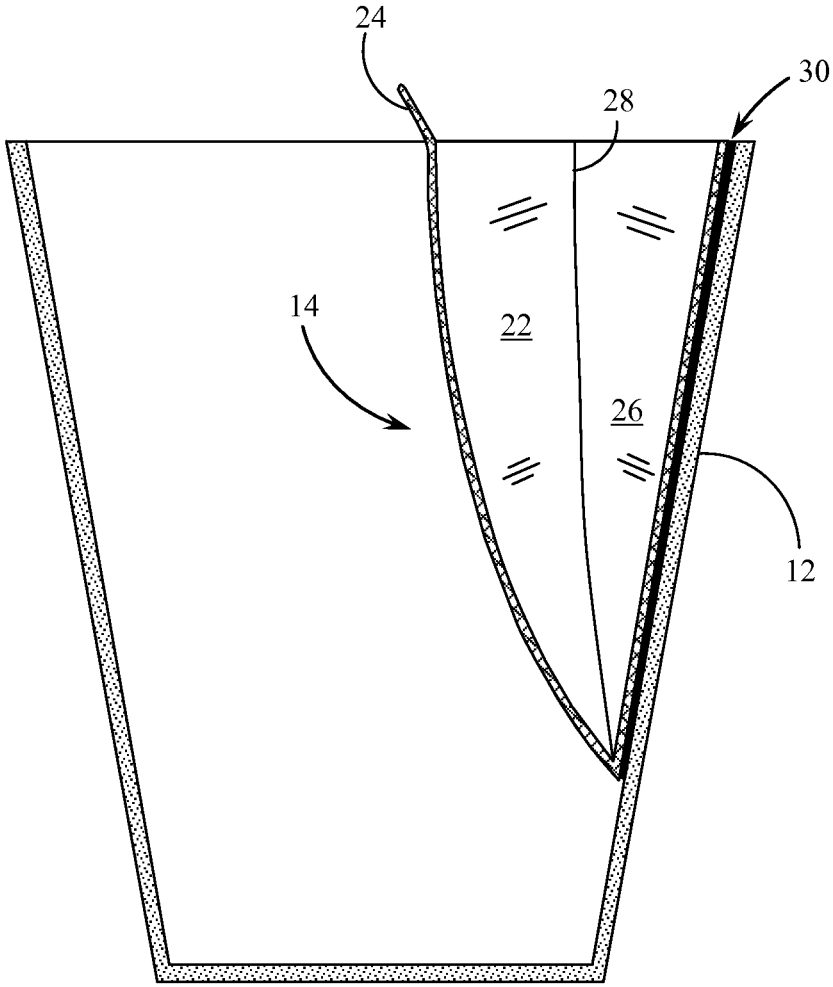
FIG. 6 is a detailed partial cross-sectional view along section line C-C' (FIG. 4B) for the first preferred embodiment of the container of the present invention.

FIG. 6 is a detailed partial cross-sectional view along section line C-C' (FIG. 4B) for the first preferred embodiment of the container of the present invention. In this view, the expandable pocket wall 22 is shown in open position extending from the container opening to an area near the bottom of the container, thus forming ice pocket 14. Expandable pocket wall 22 and fixed pocket wall 26 are joined at pocket wall seam 28. Fixed pocket wall 26 is adhered to the cup body 12 by adhesive layer 30. Although this embodiment requires an extended adhesive layer 30 for attachment of the entire fixed pocket wall 26 to the cup body 12, the alternate embodiment previously described requires only a layer of adhesive along the margins of the expandable pocket wall 22 for attachment to cup body 12.

Although the present invention has been described in terms of the foregoing preferred embodiments, this description has been provided by way of explanation only, and is not intended to be construed as a limitation of the invention. Those skilled in the art will recognize modifications of the present invention that might accommodate different ratios of ice to beverage. Those skilled in the art will further recognize additional methods for opening the expandable pocket wall besides the ice pocket tab as well as different methods of attachment of the expandable pocket wall to the cup body besides adhesive. Such modifications, as well as changes to size, structure, materials, and method of manufacture of the beverage container of the present invention, do not necessarily depart from the spirit and scope of the invention.

We claim:

1. A disposable stackable container for holding ice and a beverage, the container comprising:

(a) a beverage container body comprising a circular base, a frustoconical wall, and a circular upper rim, the circular upper rim having a diameter;

(b) an expandable ice pocket comprising two overlaid flexible walls, the ice pocket having a perimeter edge with a fixed closed portion attached to the beverage container body and an expandable open portion;

(c) wherein the ice pocket, when expanded, has a lateral dimension generally less than half the diameter of the circular upper rim of the container body and wherein the ice pocket is positioned within and attached to the container body to align the expandable open portion of the perimeter edge of the ice pocket with a portion of the upper rim of the container body;

(d) wherein the two overlaid flexible walls each comprise polymer plastic film; and (e) further wherein the two overlaid flexible walls are connected by a heat sealed seam to form a liquid barrier seal, for separating the ice from the beverage so as to cool the beverage yet prevent dilution of the beverage when the ice melts.

2. The disposable stackable container of claim 1, wherein the container body is constructed from treated paper.

3. The disposable stackable container of claim 1, wherein the container body is constructed from expanded polystyrene foam.

4. The disposable stackable container of claim 1, wherein the container body is constructed from plastic.

* * * * *